United States Patent [19]

Nishiike et al.

[11] Patent Number: 4,952,253

[45] Date of Patent: Aug. 28, 1990

[54] GRAIN-ORIENTED SILICON STEEL SHEET HAVING A LOW IRON LOSS FREE FROM DETERIORATION DUE TO STRESS-RELIEF ANNEALING AND A METHOD OF PRODUCING THE SAME

[75] Inventors: Ujihiro Nishiike; Michiro Komatsubara; Yoshiaki Iida; Isao Matoba, all of Chiba, Japan

[73] Assignee: Kawasaki Steel Corporation, Kobe, Japan

[21] Appl. No.: 120,203

[22] Filed: Nov. 5, 1987

Related U.S. Application Data

[63] Continuation of Ser. No. 918,604, Oct. 10, 1986, abandoned, which is a continuation of Ser. No. 663,385, Oct. 22, 1984, Pat. No. 4,655,854.

[30] Foreign Application Priority Data

Oct. 27, 1983 [JP] Japan ..... 58-201279
Oct. 27, 1983 [JP] Japan ..... 58-201280

[51] Int. Cl.[5] ..... H01F 1/04

[52] U.S. Cl. ..... 148/113; 148/307; 148/308

[58] Field of Search ..... 148/110–113, 148/307, 308

[56] References Cited

U.S. PATENT DOCUMENTS 2,410,220 10/1946 Langworthy ..... 148/122
2,985,855 5/1961 Stone ..... 148/113
3,544,396 12/1970 Taylor ..... 148/111
3,990,923 11/1976 Takashina et al. ..... 148/111

FOREIGN PATENT DOCUMENTS 0008385 3/1980 European Pat. Off. .
0033878 8/1981 European Pat. Off. .
56-105421 8/1981 Japan .
57-19223 11/1982 Japan ..... 148/122

OTHER PUBLICATIONS

Irie et al, "Effects of Insulating Coating on Domain Structure in Grain Oriented 3% Si-Fe Sheet as Observed with a High Voltage Scanning Electron Microscope", American Inst. of Phys. Proc. of the Sym. on Magnetism and Mag. Mat., New York, 1976, pp. 574–575.

Handbook of Chemistry and Physics, 1973, 54th ed, p. F108.

*Primary Examiner*—John P. Sheehan
*Attorney, Agent, or Firm*—Balogh, Osann, Kramer, Dvorak, Genova & Traub

[57] ABSTRACT

A grain-oriented silicon steel sheet having a low iron loss, due to the subdividing effect of magnetic domain wall spacing, free from deterioration due to the stress-relief annealing, can be obtained by forming on its surface a forsterite film locally having regions, which have a thickness different from that of the remaining regions in the film, or locally having filmless regions which do not coat the steel sheet surface.

5 Claims, 7 Drawing Sheets

GRAIN-ORIENTED SILICON STEEL SHEET HAVING A LOW IRON LOSS FREE FROM DETERIORATION DUE TO STRESS-RELIEF ANNEALING AND A METHOD OF PRODUCING THE SAME

This application is a continuation of application Ser. No. 918,604, filed Oct. 10, 1986, now abandoned which is a continuation of U.S. Ser. No. 663,385 (Now U.S. Pat. No. 4,655,854), Apr. 7, 1987.

BACKGROUND OF THE INVENTION (1) Field of the Invention:

The present invention relates to a grain-oriented silicon steel sheet having a low iron loss, and a method of producing the steel sheet, and more particularly relates to a technic for lowering the iron loss of a grain-oriented silicon steel sheet by giving ununiformity to a coating film formed on the steel sheet surface so as to define and form, on the steel sheet surface, locally regions subjected to a tensile force different from that acting upon the remaining regions of the steel sheet surface.

(2) Description of the Prior Art:

Grain-oriented silicon steel sheets are mainly used in the iron cores of a transformer and other electric instruments, and are required to have excellent magnetic properties, particularly to have a low iron loss represented by $W_{17/50}$.

In order to meet the requirement, it is necessary that the <001> orientation of secondary recrystallized grains in a steel sheet is highly aligned to the rolling direction of the steel sheet, and further that impurities and precipitates contained in the final product are decreased as possible. The iron loss value of grain-oriented silicon steel sheets produced so as to meet the requirements becomes lower year and year by laborous investigations and efforts, and recently a grain-oriented silicon steel sheet having a iron loss value of $W_{17/50}$ of 1.05 W/kg in a sheet thickness of 0.30 mm has been obtained.

However, since energy crisis in several years ago, electrical instruments having a lower iron loss are demanded more eagerly, and a grain-oriented silicon steel sheet having a lower iron loss has been demanded in order to use the steel sheet as an iron core material of the instruments.

As a means for lowering the iron loss of grain-oriented silicon steel sheet, there have generally been known metallurgical methods; for example, a method wherein the Si content is increased, a method wherein the thickness of a product steel sheet is made small, a method wherein the secondary recrystallization grains are made fine, a method wherein the content of impurities are decreased, a method wherein secondary recrystallization grains having a (110)[001] orientation are highly aligned, and the like. However, these means have been fully investigated, and the improvement of these means is very difficult, and even when the means are somewhat improved, the effect for lowering iron loss is very few.

A part from these means, Japanese Patent Application Publication No. 23,647/79 discloses a method, wherein secondary recrystallization-checking regions are formed on a steel sheet surface, thereby finely divided secondary recrystallization grains are made. However, this technic cannot control stably the size of secondary recrystallization grain, and is not a practical method.

Japanese Patent Application Publication No. 5,968/83 disclosed a technic, wherein slight strain is introduced into the surface of a secondary recrystallized steel sheet by means of a ball-point pen-like small globe to subdivide the magnetic domain wall spacing, thereby the iron loss is lowered. Japanese Patent Application Publication No. 2,252/82 discloses a technic, wherein laser beams are irradiated to the surface of a final product steel sheet at an interval of several mm in a direction substantially perpendicular to the rolling direction to introduce high dislocation density regions into the surface layer of the steel sheet, thereby the magnetic domain wall spacing is subdivided to lower the iron loss. Japanese Patent Laid-open Application No. 188,810/82 discloses a technic, wherein slight strain is introduced into a steel sheet surface layer by means of an electric spark, thereby the magnetic domain wall spacing is subdivided to lower the iron loss. In these methods, slight plastic strain is introduced into the surface layer of a secondarily recrystallized steel sheet matrix, whereby the magnetic domain wall spacing is subdivided to lower the iron loss, and these methods are practical methods, and are excellent in the effect for lowering the iron loss. However, the effect attained by the introduction of plastic strain into the steel sheet is lost by the heat treatments, such as stress-relief annealing and baking treatment of coating, which are carried out after punching, shearing, coiling and the like of the steel sheet. When it is intended to introduce very slight plastic strain into a steel sheet after a coating treatment, an insulating coating must be again applied to the steel sheet in order to maintain the insulating property, and additional steps, such as a strain-giving step and a recoating step, are required, resulting in a high production cost of grain-oriented silicon steel sheets. Japanese Patent Application Publication No. 17,757/78 discloses a technic for lowering magnetostriction of a grain-oriented silicon steel sheet by forming inorganic coating films having a stripe-shaped pattern or checkered pattern on both matrix surfaces of the steel sheet.

The object of the present invention is to provide a grain-oriented silicon steel sheet having excellent magnetic properties by subdividing the magnetic domain wall spacing based on a technical idea different from that of the above described prior arts, which steel sheet can secure its excellent magnetic properties obtained by the subdivision of magnetic domain wall spacing, even after the stress-relief annealing at high temperatures.

The present invention is based on the discoveries that, when a forsterite film constituting a surface film of a grain-oriented silicon steel sheet has locally regions having a thickness different from that of the remaining regions in the forsterite film, the magnetic domain wall spacing can be very advantageously subdivided in the resulting grain-oriented silicon steel sheet; and that, when a tension-giving type insulating coating is applied onto the above described forsterite film locally having regions having a thickness different from that of the remaining regions in the film, the effect for subdividing the magnetic domain wall spacing can be more improved by their synergistic effect.

Hereinafter, in the specification, claims and drawings, the regions in a forsterite film, which have a thickness different from that of the remaining regions in the film, may be called as "forsterite film different-thickness regions", or merely called as "different-thickness regions".

The present invention is further based on the discoveries that, when a forsterite film constituting a surface film of a grain-oriented silicon steel sheet has locally filmless regions which do not coat the steel sheet surface, the magnetic domain wall spacing of the resulting grain-oriented silicon steel sheet can be very advantageously subdivided similarly to the presence of the forsterite film different-thickness regions; and that, when a tension-giving type insulating coating is applied onto the above described forsterite film locally having the filmless regions, the effect for subdividing magnetic domain wall spacing can be more improved by their synergistic effect.

Hereinafter, in the specification, claims, and drawings, the filmless regions in a forsterite film which do not coat the steel sheet surface may be called as "non-forsterite film regions" or merely called as "filmless regions".

The subdividing effect of the magnetic domain wall spacing due to the presence of different-thickness regions or filmless regions of forsterite film is not extinguished by the stress-relief annealing, because this subdividing effect of magnetic domain wall spacing utilizes the elastic strain.

In the production of grain-oriented silicon steel sheets, a cold rolled steel sheet having a final gauge is generally subjected to a decarburization annealing to remove harmful carbon. The decarburized steel sheet has a primary recrystallization texture containing an inhibitor, which forms a fine second phase dispersed in the interior of the steel sheet, and at the same time the surface layer of the steel sheet has a subscale structure consisting of the matrix and fine $SiO_2$ grains dispersed in the matrix. After the decarburized and primary recrystallized sheet is applied on the surface with an annealing separator consisting mainly of MgO, the steel sheet is subjected to a secondary recrystallization and purification annealing (a final annealing) at a high temperature of about 1,200° C. By this secondary recrystallization, the crystal grains in the steel sheet grow into coarse grains having a {110}<001< orientation. Moreover, by the high temperature purification, a part of inhibitors, such as S, Se, N, etc., which remain in the steel sheet, is removed from the steel sheet matrix.

Furthermore, in this purification, $SiO_2$ in the subscale of the surface layer of the steel sheet and MgO in the annealing separator coated on the steel surface are reacted with each other according to the following equation:

$$2MgO+SiO_2 \rightarrow Mh_2SiO_4$$

to form a coating film consisting of a polycrystal of forsterite ($Mg_2SiO_4$) on the surface layer of the steel sheet. In this case, unreacted excess MgO serves to prevent the fusing between the fellow steel sheets. After the final annealing, the unreacted annealing separator is removed from the steel sheet, and if necessary, an insulating coating is finally coated or a coil set is removed to obtain a product steel sheet.

The inventors have reinvestigated a role of forsterite film, and found that the film gives a tensile force to a steel to subdivide the magnetic domain wall spacing and the subdivision effect of the magnetic domain wall spacing in the steel sheet varies finely depending upon positions. As the result, the inventors have reexamined carefully about the subdivision effect of the magnetic domain wall spacing in a steel sheet, and found that the above mentioned effect is remarkable in a place where the thickness of the forsterite film changes.

SUMMARY OF THE INVENTION

The first aspect of the present invention lies in a grain-oriented silicon steel sheet having a low iron loss free from deterioration due to the stress-relief annealing, said steel sheet having no plastically strained regions in the matrix surface layer and having a forsterite film, said forsterite film locally having regions, which have a thickness different from that of the remaining regions in the film.

The second aspect of the present invention lies in a grain-oriented silicon steel sheet having a low iron loss free from deterioration due to the stress-relief annealing, said steel having no plastically strained regions in the matrix surface layer and having a forsterite film, said forsterite film locally having regions, which have a thickness different from that of the remaining regions in the film, and said steel sheet further having a tension-giving type insulating coating film having a thermal expansion coefficient of not higher than $9.8\times10^{-6}$ 1/°C. formed on the forsterite film.

The third aspect of the present invention lies in a grain-oriented silicon steel sheet having a low iron loss free from deterioration due to the stress-relief annealing, said steel sheet having no plastically strained regions in the matrix surface layer and having a forsterite film, said forsterite film locally having filmless regions which do not coat the steel sheet surface.

The fourth aspect of the present invention lies in a grain-oriented silicon steel sheet having a low iron loss free from deterioration due to the stress-relief annealing, said steel sheet having no plastically strained regions in the matrix surface layer and having a forsterite film, said forsterite film locally having filmless regions which do not coat the steel sheet surface, and said steel sheet further having a tension-giving type insulating coating film having a thermal expansion coefficient of not higher than $9.8\times10^{-6}$ 1/°C. formed on the forsterite film.

DESCRIPTION OF THE PREFERRED EMBODIMENT

In the present invention, the starting material steel sheets are limited to ones having no plastically strained regions. The reason is that the subdivision of the magnetic domain wall spacing by the introduction of a plastic strain into the steel sheet causes a serious deterioration in the properties due to the stress-relief annealing as described later.

The steel sheets having a forsterite film in the present invention include not only a steel sheet having a forsterite film alone but also a steel sheet having a general top coating film formed on the forsterite film as a surface coating.

The present invention will be explained in more detail.

The inventors have changed locally the thickness of a forsterite film or have removed locally a forsterite film and have investigated the influence of the shape, thickness difference, direction, etc. of the regions, wherein the thickness of the film has been changed or the film has been removed, upon the subdivision of the magnetic domain wall spacing, and have studied relation between the shape, thickness difference, direction, etc. of the region upon the iron loss of the product steel sheet.

In this experiment, in order to decrease locally the thickness of the film or remove locally the film, forsterite was chemically dissolved in HF solution, and in order to obtain a large thickness region, chemical reaction to make $SiO_2$ on the surface was locally enhanced by coating oxidizing agent on that region.

Figure 1A:
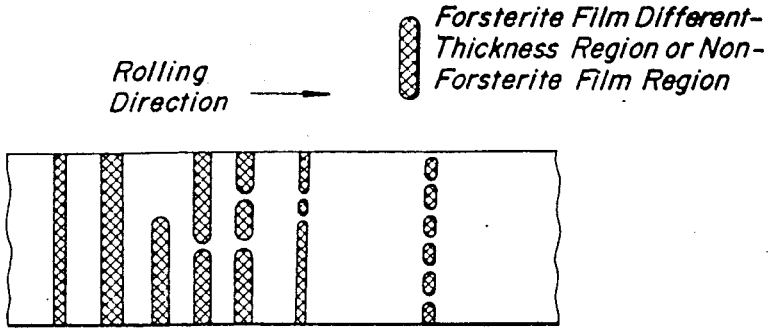
FIG. 1A is an explanative view illustrating the shapes of different-thickness regions or filmless regions defined and formed in a forsterite film.

It has been found that, as to the shape of the different-thickness region, a continuous or discontinuous linear groove or land as illustrated in FIG. 1A is especially effective for lowering the iron loss. However, in a discontinuous linear groove or land formed or recesses or protrusions arranged in a row, when the distance between adjacent recesses or protrusions is more than 0.5 mm, the effect is low. In case of the discontinuous linear groove or land party having missing portions like a dot-dashed line, the effect for lowering the iron loss is almost the same as that of the continuous linear groove or land.

Figure 1B:
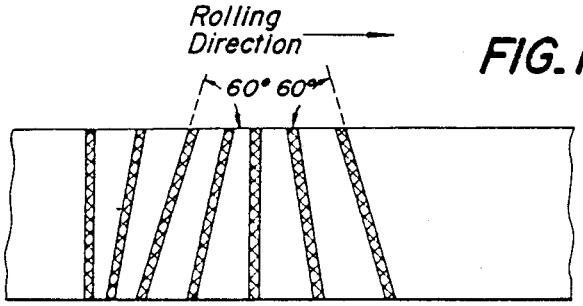
FIG. 1B is an explanative view illustrating the inclination angles of the different-thickness regions or the filmless regions with respect to the rolling direction of a steel sheet.
Figure 2:
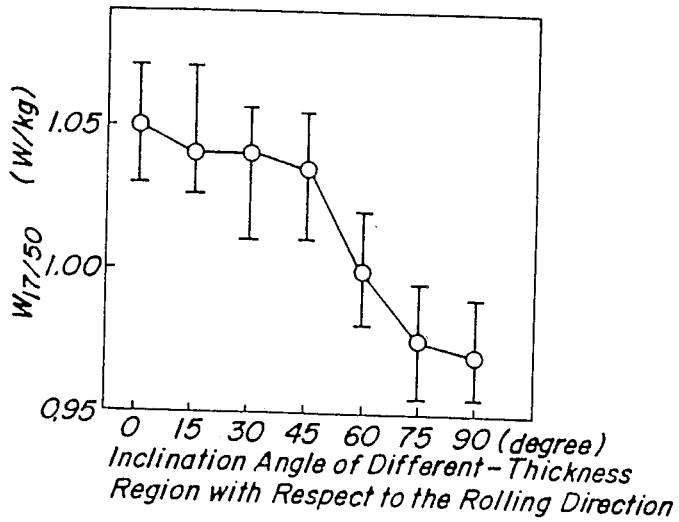
FIG. 2 is a graph illustrating the influence of the inclination angle of linear different-thickness regions with respect to the rolling direction of a steel sheet upon the iron loss value of the product steel sheet.
Figure 3:
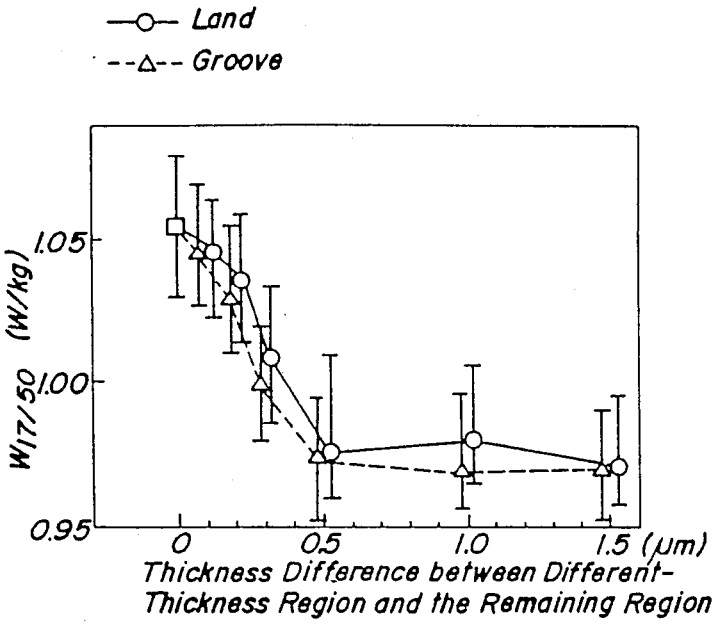
FIG. 3 is a graph illustrating a relation between the thickness difference of different-thickness regions and the iron loss value of the product steel sheet.
Figure 4:
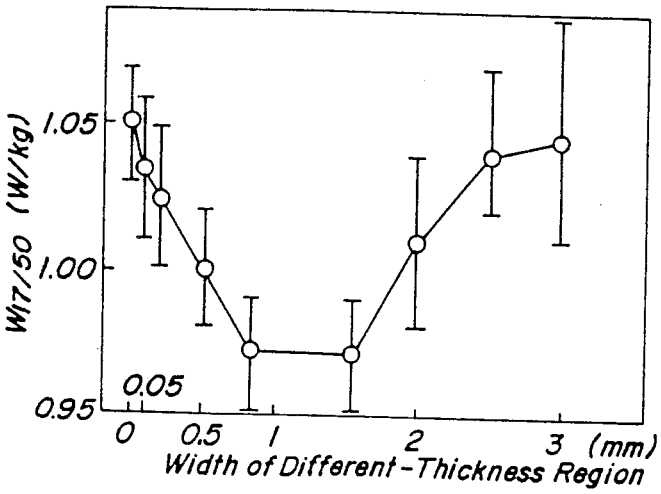
FIG. 4 is a graph illustrating a relation between the width of different-thickness regions and the iron loss value of the product steel sheet.

Regarding the direction of the different-thickness region of the forsterite film, as illustrated in FIGS. 1B and 2, it is especially effective in case of an inclination angle of 60~90° with respect to the rolling direction (measurement condition in FIG. 2: sheet thickness: 0.30 mm; dotted line-like different-thickness region, interval: 4 mm, width: 1 mm, decreased thickness: 1.5 mm). Further, regarding the thickness difference between the forsterite film different-thickness region and the remaining region, as illustrated in FIG. 3, both the larger thickness region and the smaller thickness region exhibit almost same effect. In any case, it has been found that it is effective when the thickness difference in not less than 0.3 μm (measuring condition in FIG. 3: sheet thickness: 0.30 mm, linear groove or land, interval: 5 mm, width: 0.5 mm, angle: 90°). Regarding the width of the continuous or discontinuous linear groove or land, an excellent effect is obtained in a width within the range of 0.05–2.0 mm, preferably 0.5–2.0 mm, particularly preferably 0.8–1.5 mm, as illustrated in FIG. 4 (measuring condition in FIG. 4: sheet thickness: 0.30 mm; linear land, interval: 3 mm, angle: 90°, thickness difference: 0.4 μm).

Figure 1C:
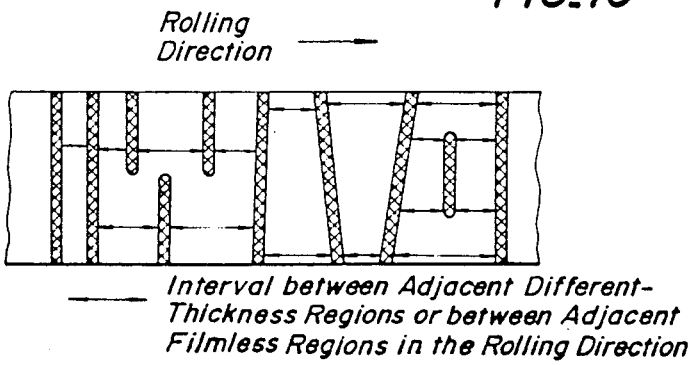
FIG. 1C is an explanative view of the intervals between adjacent different-thickness regions or adjacent filmless regions.
Figure 5:
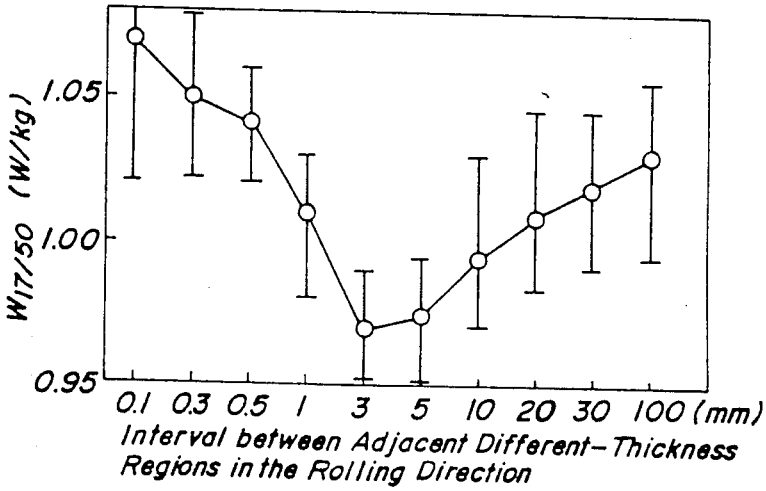
FIG. 5 is a graph illustrating a relation between the interval of adjacent different-thickness regions and the iron loss value of the product steel sheet.

Further, it is effective in order to lower the iron loss of the whole steel sheet that the different-thickness region of the forsterite film is formed repeatedly in a direction crossing the rolling direction. In this case, the interval between adjacent regions as illustrated in FIG. 1C is desirably within the range of 1–30 mm as illustrated FIG. 5 (measuring condition in FIG. 5: sheet thickness: 0.30 mm; linear groove, angle; 90°, width: 1 mm, thickness difference: 0.5 μm).

The effect of the different-thickness regions in the forsterite film is almost the same when the regions are formed on both surfaces of a steel sheet and when the regions are formed only on one surface thereof.

Figure 6:
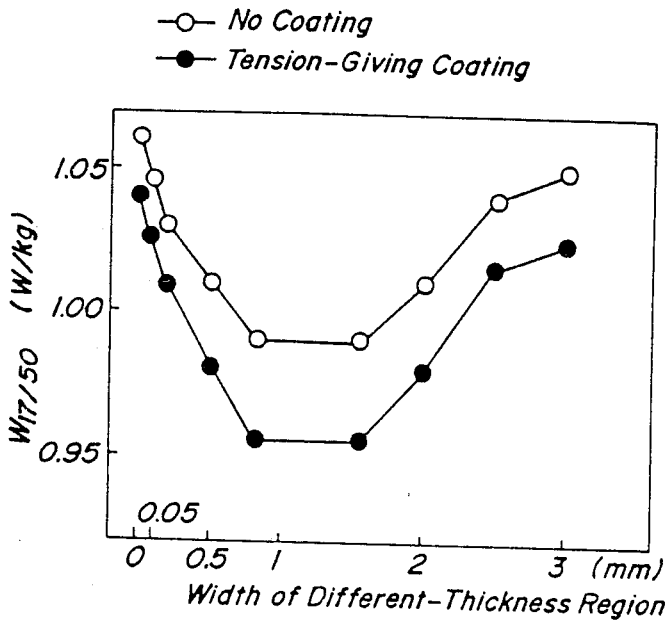
FIG. 6 is a graph illustrating relations between the width of thickness-different regions in a forsterite film and the iron loss value of the product steel sheet in the presence or absence of a tension-giving type coating film formed on the forsterite film.

It has been found that, when a steel sheet having a forsterite film locally having such different-thickness regions is coated with a coating liquid, which from a coating film having a thermal expansion coefficient of $5\times10^{-6}$ 1/°C., and baked with the liquid to form a tension-giving type coating film on the forsterite film, the iron loss of the steel sheet having the forsterite film and the tension-giving type insulating coating film is remarkably lower than that of the steel sheet merely having the forsterite film having different-thickness regions as illustrated in FIG. 6 (measuring condition in FIG. 6: sheet thickness: 0.28 mm; linear groove, interval: 3 mm, angle: 90°, thickness difference: 0.8 μm). Further, it has been found that the effect of the tension-giving type coating film is higher in the case where a forsterite film has different-thickness regions than in the case where a forsterite film has no different-thickness regions.

When various coating films having a different thermal expansion coefficients were coated on a grain-oriented silicon steel sheet having a forsterite film locally having the thickness-different regions, and the effect of the coating films was examined in the same manner as described above, it has been found that the use of a coating film having a thermal expansion coefficient of not higher than $9.9\times10^{-6}$ 1/°C. results in a satisfactorily low iron loss.

An explanation will be made with respect to the method for forming different-thickness regions in a forsterite film. The same primarily recrystallized steel sheet is used, and different-thickness regions are formed by the following methods.

(1) A method wherein the thickness of a forsterite film is controlled by utilizing a reaction for forming a forsterite film during a final annealing. For example, a method, wherein uncoated regions of an annealing separator are formed on the surface of a steel sheet after the decarburization annealing; and methods, wherein an inhibitor for the forsterite forming reaction, a substance having a water-repelling property to an annealing separator slurry, or an oxidizing agent for Si contained in the steel is locally adhered to the steel sheet surface.

(2) A method, wherein a forsterite film after a final annealing, is subjected to a chemical dissolving treatment to decrease the film thickness.

(3) A method, wherein a uniform forsterite film after a final annealing, is weakly contacted with a rotating grindstone to remove forsterite and to decrease the film thickness.

(4) A method, wherein a uniform forsterite film after a final annealing, is applied with a tension-giving type coating, and pulse-shaped high-power laser beams are irradiated to the steel sheet to volatilize the coating and the forsterite and to decrease the film thickness.

(5) A method, wherein a forsterite film after a final annealing, is applied with a tension-giving type coating, and an iron needle having a sharp point is lightly pushed to the steel sheet under a low pressure to remove the coating film together with a part of the forsterite film and to decrease the thickness of the forsterite film.

The steel sheets treated with the above described methods (1), (2) and (3) were coated with the same tension-giving type coating as that described in methods (4) and (5).

In the above described experiments, the following results were obtained. Any of methods (1)–(5) resulted in grain-oriented silicon steel sheets having a very low iron loss of $W_{17/50}$ of 0.96–0.99 W/kg. When these steel sheets were subjected to a stress-relief annealing at 800° C. for 1 hour, the steel sheets treated with methods (1), (2), (3) and (5) still had a low iron loss of 0.96–0.99 W/kg, but the iron loss of the steel sheet treated with method (4) was deteriorated to 1.04 W/kg. The inventors have ascertained the reason as follows. Among the steel sheets treated with methods (1)–(5) before the stress-relief annealing, only the steel sheet treated with method (4) had a plastically strained region formed in the matrix surface layer just beneath the decreased thickness region of the forsterite film, and this plastic strain is released and extinguished by the stress-relief annealing. Accordingly, in order not to deteriorate the iron loss due to the stress-relief annealing, it is important that plastically strained regions are not introduced into the steel sheet matrix surface layer.

In the stress-relief annealed steel sheet (5), the coating film located around the removed portion of the coating film is flowed into the removed portion of the coating film by the stress-relief annealing to as to repair the removed portion of the coating film into a uniform surface, and the coating film has excellent insulating property and corrosion resistance, It has been found that the annealing temperature necessary for repairing such coating film is preferably within the range of 600°–900° C.

There have been found out the following facts with respect to the shape, direction and the like of the non-forsterite film region in the present invention.

It has been found that, as the shape of the non-forsterite film region, a continuous or discontinuous linear non-forsterite region as illustrated in FIG. 1A is especially effective for lowering the iron loss. However, in a discontinuous linear filmless region formed of recesses arranged in a row, when the distance between adjacent recesses is more than 0.5 mm, the effect is low. In case of the discontinuous linear filmless region partly having missing portions like a dot-dashed line, the effect for lowering the iron loss is almost the same as that of the continuous linear filmless region.

Figure 7:
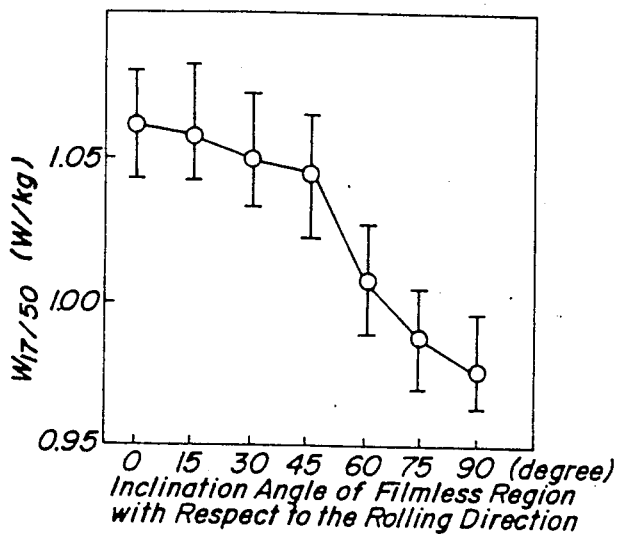
FIG. 7 is a graph illustrating the influence of the inclination angle of linear filmless regions with respect to the rolling direction of a steel sheet upon the iron loss value of the product steel sheet.
Figure 8:
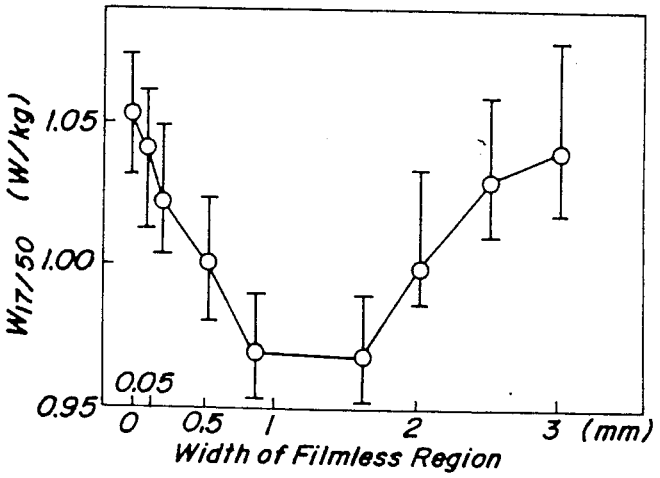
FIG. 8 is a graph illustrating a relation between the width of filmless regions and the iron loss value of the product steel sheet.

Regarding the direction of the non-forsterite film region, as illustrated in FIGS. 1B and 7, it is especially effective in case of an inclination angle of 60°–90° with respect to the rolling direction (measuring condition in FIG. 7: sheet thickness: 0.30 mm; dotted line-like filmless region, interval: 4 mm, width: 1 mm). Regarding the width of the continuous or discontinuous linear filmless region, an excellent effect is obtained within the range of 0.05–20.0 mm, preferably 0.8–1.5 mm, as illustrated FIG. 8 (measuring condition in FIG. 8: sheet thickness: 0.30 mm; linear filmless region, interval: 3 mm, angle: 90°).

Figure 9:
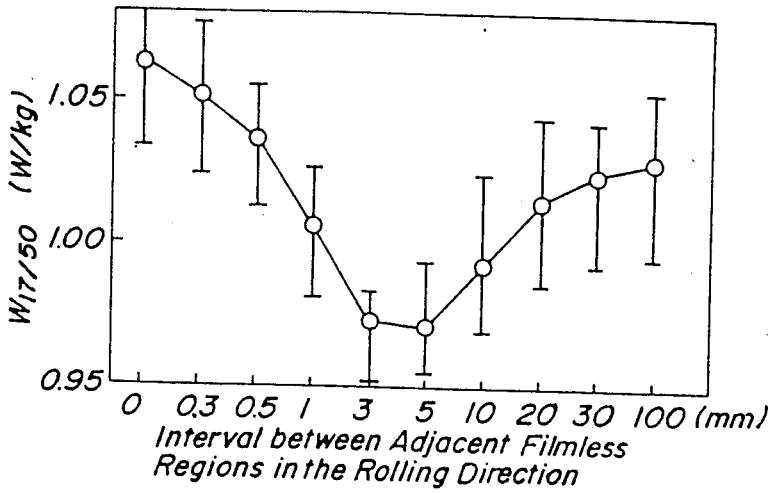
FIG. 9 is a graph illustrating a relation between the interval of adjacent filmless regions and the iron loss value of the product steel sheet.

Further, it is effective in order to lower the iron loss of the whole steel sheet that the filmless region of the forsterite film is formed repeatedly in a direction crossing the rolling direction. In this case, the distance between adjacent regions as illustrated in FIG. 1C is desirably within the range of 1–30 mm as illustrated FIG. 9 (measuring condition in FIG. 9: sheet thickness: 0.30 mm; linear filmless region, angle: 90°, width: 1 mm).

The effect of the filmless regions in a forsterite film is almost the same in the case where the film is formed on both surfaces of a steel sheet and in the case where the film is formed only on one surface thereof.

Figure 10:
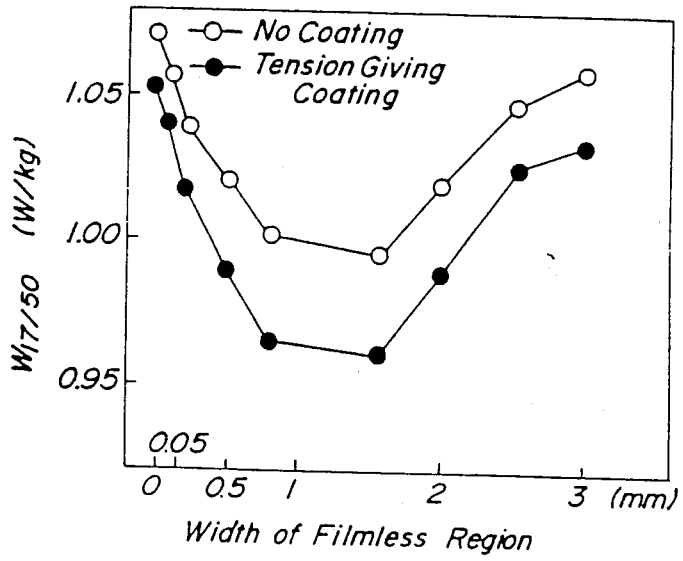
FIG. 10 is a graph illustrating relations between the width of filmless regions in a forsterite film and the iron loss value of the product steel sheet in the presence or absence of a tension-giving type casting film formed on the forsterite film.

It has been found that, when a steel sheet having a forsterite film locally having such filmless regions is coated with a coating liquid, which forms a coating film having a thermal expansion coefficient of $5\times10^{-6}$ 1/°C., and baked with the liquid to form a tension-giving type coating film on the forsterite film, the iron loss of the steel sheet having the forsterite film and the tension-giving type insulating coating film is remarkably lower than that of the steel sheet merely having the forsterite film having filmless regions as illustrated in FIG. 10 (measuring condition in FIG. 10: sheet thickness: 0.28 mm, linear filmless region, interval: 4 mm, angle: 90°). Further it has been found that the effect of the tension-giving type coating film is higher in the case where a forsterite film has filmless regions than in the case where a forsterite film has no filmless regions.

When various coating films having different thermal expansion coefficients were coated on a grain-oriented silicon steel sheet having a forsterite film locally having the filmless regions, and the effect of the coating films was examined in the same manner as described above, it has been found that the use of a coating film having a thermal expansion coefficient of not higher than $9.8\times10^{-6}$ 1/°C. results in a satisfactorily low iron loss.

An explanation will be made with respect to the method for forming a forsterite film locally having filmless regions which do not coat a steel sheet surface.

A finally annealed silicon steel sheet having a forsterite film on the matrix surface and further having a tension-giving type coating film having a thermal expansion coefficient of $5.6\times10^{-6}$ 1/°C. formed on the forsterite film was divided into 4 steel sheets, and non-forsterite film regions, each having a width of 1.0 mm were formed at an inclination angle of 90° with respect to the rolling direction and at a repeating interval of 4 mm by the following methods.

(1) The forsterite film is locally dissolved in a connected NaOH solution to form linear filmless regions.

(2) A disc-shaped grinding stone is weakly contacted with the steel sheet to form linear filmless regions.

(3) Pulse-shaped high-power laser beams are irradiated to the steel sheet to volatize both the coating and the forsterite and to form dotted line-like filmless regions (distance between adjacent recesses: 0.4 mm).

(4) An iron needle having a sharp point is lightly pushed to the steel sheet under a light pressure to form dotted line-like filmless regions (distance between adjacent recesses: 0.4 mm).

Any of the above described methods (1)–(4) resulted in grain-oriented silicon steel sheets having a very low iron loss of $W_{17/20}$ of 0.97–0.98 W/kg. When these steel sheets were subjected to a stress-relief annealing at 800° C. for 3 hours, the steel sheets treated with methods (1), (2) and (4) still had a low iron loss of 0.97–0.98 W/kg, but the iron loss of the steel sheet treated with method (3) was noticeably deteriorated to 1.05 W/kg.

The inventors have ascertained the reason as follow. Among the steel sheets treated with methods (1)–(4) before the stress-relief annealing, only the steel sheet treated with method (3) had a plastically strained region formed in the matrix surface layer just beneath the region, wherein the forsterite film has been removed, and this plastic strain is released and extinguished by the stress-relief annealing. Accordingly, in order not to deteriorate the iron loss due to the stress-relief annealing, it is important that plastically strained regions are not introduced into the steel sheet matrix surface layer.

In the stress-relief annealed steel sheets (1)–(4), the coating film located around the removed portion of the coating film is flowed into the removed portion of the coating film by the stress-relief annealing so as to repair the removed portion of the coating film into a uniform surface, and the coating film has excellent insulating property and corrosion resistance. It has been found that the annealing temperature necessary for repairing such coating film is preferably within the range of 600°–900° C.

An explanation will be made hereinafter with respect to the method of producing the grain-oriented silicon steel sheet of the present invention.

As the starting material in the present invention, there is used a hot rolled coil produced by a method, wherein a molten steel is produced by a commonly known steelmaking process, for example, by a converter, an electric furnace, etc., the molten steel is subjected to an ingot making slabbing process or a continuous casting process etc. to produce a slab, and the slab is subjected to a hot rolling.

It is necessary that the hot rolled sheet has a composition containing about 2.0–4.0% by weight of Si. The reason is that the Si content of less than 2.0% results in a grain-oriented silicon steel sheet having a very poor iron loss, and the Si content of more than 4.0% results in a poor cold workability of the hot rolled sheet. As to other constituents, any constituents for grain-oriented silicon steel sheets are applicable.

The hot rolled sheet is subjected to one cold rolling or two or more cold rollings with an intermediate annealing between them to produce a cold rolled sheet having a final gauge. In this case, if necessary, a normalizing annealing of a hot rolled sheet or a warm annealing instead of the cold rolling may be carried out.

The cold rolled sheet having a final gauge is subjected to a primary recrystallization annealing under an oxidizing atmosphere capable of decarburization or under a weak oxidizing atmosphere capable of forming a subscale. Then, an annealing separator consisting mainly of MgO is applied to the steel sheet surface. In this application step, regions not applied with the annealing separator are locally formed on the steel sheet surface, whereby the object aimed in the present invention are advantageously achieved.

That is, by carrying out the final annealing, an ordinary forsterite film is formed on the surface applied with the annealing separator. On the contrary, merely a thin forsterite film is formed on the surface not applied with the annealing separator, so that a small thickness region directed in the first and second aspects of the present invention is formed.

Further, as methods of adhering the annealing separator to the steel sheet, commonly known methods of application by a roll or a brush, spraying and electrostatic painting can be used.

As the other methods for forming the different-thickness region directed in the first and second aspects of the present invention, there are four methods as described hereinafter besides the above-mentioned method.

(1) A method, wherein, before applying an annealing separator to a steel sheet surface after the primary recrystallization annealing, an inhibitor for the forsterite forming reaction is locally adhered to the steel sheet surface in an amount within the range of not more than 1 g/m$^2$.

In this method, as the inhibitor, there can be used oxides such as $SiO_2$, $Al_2O_3$, $ZrO_2$, etc. and metals such as Zn Al, Sn, Ni, Fe, etc. When the inhibitor is adhered to the steel sheet surface in an amount of more than 1 g/m$^2$, the inhibiting effect for the reaction becomes excessive and a forsterite film is not formed. Hence, it is necessary that the thickness of a forsterite film to be decreased is controlled by using the inhibitor in an amount persistently within the range of not more than 1 g/m$^2$. As a means for applying these reaction inhibitors to the steel sheet, any of application, spraying, plating, printing, electrostatic painting, etc. are available.

(2) A method, wherein, before applying an annealing separator to a steel sheet surface after the primary recrystallization annealing, a substance having a water repelling property to an annealing separator slurry (a suspension of an annealing separator in water) is locally adhered to the steel sheet surface in an amount within the range of not more than 0.1 g/m$^2$.

As such water-repelling substances, oil paint and varnish, etc. are advantageously used. The water-repelling substances prevent the contact of the steel sheet surface with the annealing separator to delay the forsterite forming reaction and to form the smaller thickness region. However, when the substances are adhered to the steel sheet in an amount of more than 0.1 g/m$^2$, the reaction-delaying effect becomes excessive, and a forsterite film is not at all formed. Therefore, it is necessary that the thickness of a forsterite film to be decreased is controlled by using the water-repelling substance in an amount persistently within the range of not more than 0.1 g/m$^2$. Further, as a means for adhering the water-repelling substance to a steel sheet, there can be used application, spraying, printing, electrostatic painting, etc. similarly to the above described reaction inhibitors.

(3) A method, wherein, before applying an annealing separator to a steel sheet surface after the primary recrystallization annealing, an oxidizing agent for Si contained in the steel is locally adhered to the steel sheet surface in an amount within the range of not more than 2 g/m$^2$.

The oxidizing agent oxidizes Si in the steel at a high temperature during the following final annealing to increase the amount of $SiO_2$ particles in the subscale of the steel sheet surface layer and to increases the thickness of a forsterite film after the final annealing. Hence, the larger thickness film can be locally formed on the steel sheet surface. As the oxidizing agent, there can be advantageously used oxides, such as FeO, $Fe_2O_3$, $TiO_2$, etc., easily reducible silicates, such as $Fe_2$ $SiO_4$, etc. hydroxides, such as $Mg(OH)_2$, etc. However, when the adhered amount of these oxiding agents to the steel sheet surface exceeds 2 g/m$^2$, the thickness of the resulting oxide films becomes too large, and the adhesive force of the film to the steel sheet is lost, and the film peels away. As the result, the expected object can not be attained.

(4) A method, wherein a forsterite film formed on the steel sheet surface after the final annealing, is removed without causing a plastic strain in the matrix steel sheet surface layer, thereby smaller thickness regions are formed.

As the method, besides a chemical polishing and an electrolytic polishing, there are methods of removing the forsterite film by a rotating disc-like grindstone, by an iron needle under a light pressure, and by an optical means, for example laser beams, etc. having a power properly adjusted, and other methods. Especially, when laser beams are used as the optically removing method, multiple beams may be taken out from one light source or the whole irradiation may be effected in the presence of an appropriate masking, whereby a plural number of different-thickness regions can be advantageously formed efficiently by one operation.

Further, in the third and the fourth aspects of the present invention, in order to produce the non-forsterite film regions, among the above mentioned methods of (1), (2), (3) and (4), methods of (1), (2) and (4) are available. However, in these 3 methods, when the methods of (1) and (2) are used, it is necessary to determine the amount of the treating agents as described hereinafter.

(1) When an inhibitor for the forsterite forming reaction is used, the inhibitor must be locally adhered to the surface of a steel sheet after the primary recrystallization annealing, in an amount within the range of more than 1 g/m$^2$ before the annealing separator is applied to the steel sheet surface. When the adhered amount of the reaction inhibitor to the steel sheet surface is not more than 1 g/m$^2$, there is a risk of forming a forsterite film, and hence the adhered amount of the reaction inhibitor has been determined within the range of more than 1 g/m$^2$ in order to avoid the risk.

(2) When a substance having a water-repelling property to an annealing separator slurry (a suspension of an annealing separator in water) is used, the water-repelling substance must be locally adhered to the surface of a steel sheet after the primary recrystallization annealing, in an amount within the range of more than 0.1 g/m$^2$ before the annealing separator is applied to the steel sheet surface. When the adhered amount of the water-repelling substance to the steel sheet surface is not more than 0.1 g/m$^2$, there is a risk of forming a forsterite film, and hence the adhered amount has been determined within the range of more than 0.1 g/m$^2$ in order to avoid the risk.

In the method of forming the different-thickness region or filmless region by the above described removal method, special care must be taken not to form a plastically strained region on the matrix surface during the removal treatment. The reason is that, when the plastic strain is introduced into the matrix surface the properties of the steel sheet after the stress-relief annealing is noticeably deteriorated as described hereinafter.

As to the shape of the different-thickness region or filmless region, a continuous linear groove or land is especially effective. The continuous linear groove or land can be replaced by a discontinuous linear groove or land, that is, by recesses or protrusions arranged in a row. However, in case of such a discontinuous linear groove or land, when the distance between adjacent recesses or protrusions is more than 0.5 mm, the effect is low. Further, when the width of the linear different-thickness region or linear filmless region is about 0.05–2.0 mm, the effect is high.

Regarding the direction of the linear groove or land, an inclination angle within the range of 60–90° with respect to rolling direction is especially preferable. When the direction is parallel to the rolling direction, there is no effect, and when the direction is perpendicular to the rolling direction, the highest effect is obtained. The inclination angle with respect to the rolling direction of the steel sheet is especially important. The reason why the effect for lowering the iron loss is poor in case of excessively large width of the different-thickness region or filmless region, or in case of isolated recesses or protrusions, is probably that the directional effect of the whole regions does not sharply appear.

It is preferable that the continuous or discontinuous linear groove or land is arranged repeatedly with respect to the rolling direction. In this case, it is especially effective that the interval between adjacent grooves or lands is within the range of 1.0–30 mm. The continuous or discontinuous linear groove or land may have different shapes and widths, and may be arranged in different angles with respect to the rolling direction.

Further, the forsterite film different-thickness region or the non-forsterite film region exhibits almost the same effect in the case where the region is present on both surfaces of a steel sheet and in the case where the region is present only on one surface of the steel sheet.

When a tension-giving type insulating coating film having a thermal expansion coefficient of not higher than $9.8\times10^{-6}$ 1/°C. as a top coating is formed on the grain-oriented silicon steel sheet locally having the above described forsterite film different-thickness region or non-forsterite regions, grain-oriented silicon steel sheets having more excellent magnetic properties of the present invention can be obtained.

Alternatively, the silicon steel sheet having more excellent magnetic properties of the present invention can be produced in the following manner. A tension-giving type insulating coating film having a thermal expansion coefficient of not more than $9.8\times10^{-6}$ 1/°C. as a top coating is formed on a grain-oriented silicon steel sheet having a forsterite film, and then the top coating and a part of the forsterite film of the top coating and the forsterite film are locally removed to form small thickness regions of the forsterite film or to form non-forsterite film regions on the steel sheet, and then the steel sheet is subjected to an annealing at a temperature of 600°–900° C. to repair the final coating-absent portion.

The top coating gives a surface tension to a steel sheet surface by the difference in thermal expansion coefficient between the steel sheet and the coating film, and therefore it is necessary that the top coating film has a thermal expansion coefficient somewhat different from that of the steel sheet. The inventors have ascertained that a top coating film having a thermal expansion coefficient of not higher than $9.8\times10^{-6}$ 1/°C. gives a satisfactorily low iron loss value to the product steel sheet by the synergistic effect of the effect caused by the presence of different-thickness region or filmless region in the forsterite film and the surface tension-giving effect of the top coating film.

The thickness of the coating film is preferably within the range of about 0.5–10 g/m$^2$ (per one surface) in view of corrosion resistance and space factor.

Moreover, in the steel sheet of the present invention, only the shape of the coating film portion is changed and therefore the change of the shape is small, and the lowering of space factor does not substantially occur.

As described above, the grain-oriented silicon steel sheets having a forsterite film locally having different-thickness regions or locally having filmless regions exhibit excellent magnetic properties in both cases, wherein the steel sheets are directly used in a practical apparatus similar to the commonly used grain-oriented silicon steel sheets, and wherein the steel sheets are used in a practical apparatus after the sheets are subjected to the top insulation coating.

According to the present invention, the iron loss value is lowered by defining and forming different-thickness regions or filmless regions in a forsterite film. The reason is probably that regions, which are subjected to a tension different from that acting upon the remaining region of a steel sheet surface, are formed on the steel sheet surface by forming thickness-different regions or filmless regions in a forsterite film, and the plastic strain is introduced into the steel sheet surface by the action of the different tension, so that the magnetic domain wall spacing is effectively subdivided.

In the grain-oriented silicon steel sheet having a elastic strain caused by the different tension, there is no artificially and plastically strained regions in the steel sheet matrix surface layer contrary to the conventional methods, wherein plastically strained regions or high dislocation density regions, such as laser beam marks, are formed in the matrix surface layer, and therefore deterioration of iron loss does not substantially occur even when a stress-relief annealing is carrier out under a commonly used condition of about 800° C. and of from 1 minute to several hours. In the conventional grain-oriented silicon steel sheet, the plastic strain in the surface layer of a matrix is extinguished at a high temperature. Therefore, the conventional steel sheet has a fetal defect that the iron loss deteriorates. However, the grain-oriented silicon steel sheet of the present invention has satisfactorily low iron loss regardless of stress-removing annealing.

The present invention will be explained with reference to specific examples.

EXAMPLE 1

A cold rolled steel sheet of 0.30 mm in thickness was prepared from a hot rolled silicon steel sheet containing 3.2% of Si according to the ordinary method, and subjected to a decarburization-primary recrystallization annealing. Then, before an annealing separator was applied to the surface of the annealed sheet , $Al_2O_3$ powder as an inhibitor for the forsterite forming reaction was adhered linearly to the steel sheet surface under a condition that the adhesion amount; 0.5 g/m$^2$, the inclination angle with respect to the rolling direction: 90°, the adhesion width: 2 mm, and the repeating interval in the rolling direction: 4 mm. Thereafter, the annealing separator was applied onto the thus treated steel sheet, and then the steel sheet was subjected to a final annealing at 1,200° C. for 5 hours.

For comparison, a grain-oriented silicon steel sheet was prepared as a Comparative Example according to the ordinary method wherein $Al_2O_3$ powder was not adhered.

Examination of the film properties showed that, in the Comparative Example, a grey film of a uniform thickness was formed, while in this Example 1, a forsterite film having a thickness smaller by 0.8 μm was formed in the regions to which the $Al_2O_3$ powder was applied, than the thickness at the region to which the $Al_2O_3$ powder was not applied. The iron loss values of Example and Comparative Example were as follows:

Comparative Example: $W_{17/50}=1.06$ W/kg
Example: $W_{17/50}=1.02$ W/kg

An ordinary phosphate type top coating was applied to the above treated steel sheets, and iron loss values of the top-coated steel sheets were measured. The following results were obtained.

Comparative Example: $W_{17/50}=1.06$ W/kg
Example: $W_{17/50}=1.01$ W/kg

Further, the above top coated steel sheets were subjected to a stress-relief annealing at 800° for 2 hours, and the iron loss values of the annealed sheets were measured. The obtained values are as follows.

Comparative Example: $W_{17/50}=1.06$ W/kg
Example: $W_{17/50}=1.01$ W/kg

EXAMPLE 2

A cold rolled steel sheet of 0.28 mm in thickness was prepared from a hot rolled silicon steel sheet containing 3.0% of Si according to the ordinary method, and subjected to a decarburization-primary recrystallization annealing. After an annealing separator consisting mainly of MgO was once applied onto the surface of the annealed steel sheet, the annealing separator was removed linearly by a plastic bar with a fine tip under a condition that the inclination angle with respect to the rolling direction: 90°, the width: 0.5 mm, and the repeating interval in the rolling direction: 2 mm. Then, the steel sheet was subjected to a final annealing at 1,200° C. for 5 hours. A steel sheet treated up to the final annealing step according to the ordinary steps, wherein the annealing separator was not removed, was adopted as a Comparative Example.

Examination of the film properties of both the samples showed, that, in Comparative Example, a grey forsterite film of a uniform thickness was formed, while in Example 2, a forsterite film having a small thickness was formed at the regions at which the annealing separator was removed. The iron loss values of Example 2 and Comparative Example were as follows:

Comparative Example: $W_{17/50}=1.07$ W/kg
Example: $W_{17/50}=1.01$ W/kg

When these samples steel sheets were subjected to a stress-relief annealing at 800° C. for 5 hours, and the iron loss values of the steel sheets were measured. The following values were obtained.

Comparative Example: $W_{17/50}=1.07$ W/kg
Example: $W_{17/50}=1.01$ W/kg

EXAMPLE 3

A cold rolled steel sheet of 0.23 mm in thickness was prepared from a hot rolled silicon steel sheet containing 3.0% of Si according to the ordinary method, and subjected to a decarburization primary recrystallization annealing. After an annealing separator consisting mainly of MgO was once applied onto the surface of the annealed steel sheet, the annealing separator was removed linearly by a plastic bar with a fine tip under a condition that the inclination angle with respect to the rolling direction: 90°, the width: 0.5 mm, and the repeating interval in the rolling direction: 5 mm. Then, the steel sheet was subjected to a final annealing at 1,200° C. for 5 hours. A steel sheet treated up to the final annealing step according to the ordinary steps, wherein the annealing separator was not removed was adopted as a Comparative Example.

Examination of the film properties of both the samples showed that, in Comparative Example, a grey forsterite film of a uniform thickness was formed; while in Example 3, a forsterite film having a small thickness was formed at the regions at which the annealing separator was removed. The iron loss values of Example 3 and Comparative Example were as follows:

Comparative Example: $W_{17/50}=0.93$ W/kg

Example: $W_{17/50}=0.84$ W/kg

When these sample steel sheets were subjected to a stress-relief annealing at 800° C. for 5 hours, and the iron loss values of the steel sheets were measured. The following values were obtained.

Comparative Example: $W_{17/50}=0.93$ W/kg

Example: $W_{17/50}=0.84$ W/kg

EXAMPLE 4

A cold rolled steel sheet of 0.30 mm in thickness was prepared from a hot rolled silicon steel sheet containing 3.0% of Si according to the ordinary method, and subjected to a decarburization primary recrystallization annealing. Then, an annealing separator was applied to the surface of the steel sheet by means of a rubber roll with ridges. At this time, the annealing separator was applied to the steel sheet surface such that applied regions and non-applied regions were alternatively defined and formed with respect to the rolling direction under a condition that the width of the non-applied region: 1.5 mm, and the repeating interval in the rolling direction: 5 mm. Thereafter, the steel sheet was subjected to a final annealing at 1,200° C. for 5 hours. For comparison, a grain-oriented silicon steel sheet as a Comparative Example was prepared according to the ordinary production steps in which the forsterite film was uniformly formed over the whole surface of the steel sheet.

Examination of the film properties of both the samples showed that, in the Comparative Example, a grey forsterite film of a uniform thickness was formed; while in Example 4, a forsterite film of a small thickness was formed at the regions at which no annealing separator was applied. The iron loss values of these samples were as follows:

Comparative Example: $W_{17/50}=1.05$ W/kg

Example: $W_{17/50}=1.03$ W/kg

When these samples steel sheets were subjected to a stress-relief annealing at 800° C. for 1 hour and the iron loss values of the steel sheets were measured. The following values were obtained.

Comparative Example: $W_{17/50}=1.08$ W/kg

Example: $W_{17/50}=1.03$ W/kg

EXAMPLE 5

A cold rolled steel sheet of 0.30 mm in thickness was prepared from a hot rolled silicon steel sheet containing 3.2% of Si according to the ordinary method, and subjected to a decarburization primary recrystallization annealing. Then, prior to the application of an annealing separator, FeO as an oxidizing agent for Si contained in the steel was linearly applied to the surface of the steel sheet under a condition that the amount of FeO: 0.5 g/m$^2$, the inclination angle with respect to the rolling direction: 90°, the width: 2 mm, and the repeating interval in the rolling direction: 10 mm. Thereafter, the annealing separator was applied onto the surface of the thus treated steel sheet, and then the steel sheet was subjected to a final annealing at 1,200° C. for 5 hours. For comparison, a grain-oriented silicon steel sheet was prepared as a Comparative Example according to the ordinary steps in which no oxidizing agent was applied prior to the application of the annealing separator. The iron loss values were as follows:

Comparative Example: $W_{17/50}=1.04$ W/kg

Example: $W_{17/50}=0.99$ W/kg

After a stress-relief annealing was performed for the above treated steel sheets at 800° C. for 2 hours, the iron loss values thereof were measured. The following values were obtained.

Comparative Example: $W_{17/50}=1.04$ W/kg

Example: $W_{17/50}=0.99$ W/kg

EXAMPLE 6

A cold rolled steel sheet of 0.20 in thickness was prepared from a hot rolled silicon steel sheet containing 3.2% of Si according to the ordinary method, and subjected to a decarburization primary recrystallization annealing. Then, prior to the application of an annealing separator, the surface of the steel sheet was printed with an oil paint having water-repellent property to the annealing separator slurry in an amount of 0.05 g/m$^2$ by a printing process in the form of a discontinuous straight line under a condition that the inclination angle of the printed regions with respect to the rolling direction: 90°, the width: 0.3 mm, the distance between adjacent spots arranged in a row; 0.3 mm, and the interval of the adjacent printed regions in the rolling directions: 3 mm.

Thereafter, the annealing separator was applied to the printed steel sheet, the applied steel sheet was dried under heating, and then subjected to a final annealing at 1,200° C. for 10 hours. For comparison, a grain-oriented silicon steel sheet was prepared as a Comparative Example according to the ordinary steps in which the above mentioned printing treatment of the water-repelling substance was not performed.

The iron low values of both the samples were as follows:

Comparative Example: $W_{17/50}=0.92$ W/kg

Example: $W_{17/50}=0.87$ W/kg

The following values were obtained with respect to the iron loss values after a stress-relief annealing was performed at 800° C. for 2 hours.

Comparative Example: $W_{17/50}=0.92$ W/kg

Example: $W_{17/50}=0.87$ W/kg

EXAMPLE 7

A cold rolled steel sheet of 0.30 mm in thickness was prepared from a hot rolled silicon steel sheet containing 3.2% of Si according to the ordinary method, and subjected to a decarburization primary recrystallization annealing. Then, an annealing separator consisting mainly of MgO was applied onto the surface of the steel sheet, and the applied steel sheet was subjected to a final annealing at 1,200° C. for 5 hours to form a grain-oriented silicon steel sheet with a grey forsterite film on the surface thereof.

The iron loss value of this steel sheet was 1.06 W/kg at $W_{17/50}$.

Then, an iron needle with a fine tip was pushed to the steel surface under a light pressure and moved thereon to draw a line and to remove the forsterite film, whereby linear decreased thickness regions of the forsterite film were formed in the forsterite film, which regions were arranged under a condition that the depth: 0.5 μm, the width: 0.5 mm, the inclination angle with respect to the rolling direction: 90, and the interval between adjacent regions in the rolling direction: 6 mm.

As a result, the iron loss of the steel sheet thus obtained was 1.02 W/kg at $W_{17/50}$. The iron loss value after a stress-relief annealing of the above obtained steel sheet at 850° C. for 2 hours was 1.01 W/kg at $W_{17/50}$.

EXAMPLE 8

A cold rolled steel sheet of 0.30 mm in thickness was prepared from a hot rolled silicon steel sheet containing 3.2% of Si according to the ordinary method, and subjected to a decarburization primary recrystallization annealing. The resulting steel sheet was divided into two pieces, and one of them as such was coated with an annealing separator consisting mainly of MgO, and then subjected to a final annealing at 1,200° C. for 5 hours, which was used as a Comparative Example. The other steel sheet piece was adhered linearly on its surface with $Al_2O_3$ powder as an inhibitor for the forsterite forming reaction under a condition that the adhesion amount: 0.5 g/m$^2$, the inclination angle with respect to the rolling direction: 9020 , the adhesion width: 2 mm, and the repeating interval in the rolling direction: 4 mm, and then the annealing separator was applied thereon, followed by a final annealing.

As a result, in the former case, a uniform grey film was formed; while, in the latter case, a thin forsterite film having a thickness smaller by 0.8 μm than that of the forsterite film formed at the regions, to which the $Al_2O_3$ powder was not applied, was formed at the regions to which the $Al_2O_3$ powder was applied. The iron loss values of these steel sheets were as follows:

Steel sheet with a uniform film: $W_{17/50}=1.06$ W/kg

Steel sheet with a film having reduced thickness regions: $W_{17/50}=1.02$ W/kg

Next, each of coating liquids I–VII shown in Table 1 was applied and baked onto each of the above steel sheets to form a top coat insulating film thereon. The iron loss values of the thus obtained products are shown in Table 2. Then, the iron loss values of the steel sheets, after a stress-relief annealing at 800° C. for 2 hours, were measured and the obtained results are also shown in Table 2.

It can be seen from Table 2 that the iron loss of the steel sheets having a forsterite film locally having different-thickness regions defined and formed therein are conspicuously improved by the coating film having a thermal expansion coefficient of not higher than $9.8\times10^{-6}$ 1/°C.

TABLE 1

| Kind of coating liquid | Ingredient: Sodium hydroxide (g) | Aluminum phosphate (g) | Magnesium phosphate (g) | $SiO_2$ content in colloidal silica (g) | Chromic anhydride (g) | Amount in 100 ml solution: Amount of $SiO_2$ fine particle (50–1000Å) (g) | Thermal expansion coefficient of coating film (1/°C.) |
|---|---|---|---|---|---|---|---|
| I | 5 | — | 20 | 8 | — | 0.5 | $15\times10^{-6}$ |
| II | — | — | 20 | — | 3 | — | $10\times10^{-6}$ |
| III | 1 | 25 | — | 6 | 1 | 3 | $9.8\times10^{-6}$ |
| IV | 0.5 | 10 | 15 | 8 | — | 1 | $8.3\times10^{-6}$ |
| V | — | 12 | 16 | 10 | 2 | 0.5 | $6.7\times10^{-6}$ |
| VI | — | — | 25 | 13 | 3 | 1 | $5.6\times10^{-6}$ |
| VII | — | 20 | — | 12 | 4 | — | $4.8\times10^{-6}$ |

TABLE 2

| Kind of coating | Decreased thickness regions in forsterite film | Iron loss value before coating $W_{17/50}$ (W/kg) | Iron loss value after coating $W_{17/50}$ (W/kg) | Iron loss value after stress-relief annealing $W_{17/50}$ (W/kg) | Remarks |
|---|---|---|---|---|---|
| I | No | 1.06 | 1.06 | 1.06 | Comparative example |
| | Present | 1.02 | 1.02 | 1.02 | Comparative example |
| II | No | 1.06 | 1.06 | 1.06 | Comparative example |
| | Present | 1.02 | 1.01 | 1.01 | Comparative example |
| III | No | 1.06 | 1.05 | 1.05 | Comparative example |
| | Present | 1.02 | 0.99 | 0.99 | Example |
| IV | No | 1.06 | 1.05 | 1.05 | Comparative example |
| | Present | 1.02 | 0.98 | 0.98 | Example |
| V | No | 1.06 | 1.04 | 1.04 | Comparative example |
| | Present | 1.02 | 0.97 | 0.97 | Example |
| VI | No | 1.06 | 1.04 | 1.04 | Comparative example |
| | Present | 1.02 | 0.96 | 0.96 | Example |
| VII | No | 1.06 | 1.04 | 1.04 | Comparative example |
| | Present | 1.02 | 0.96 | 0.96 | Example |

EXAMPLE 9

A grain-oriented silicon steel sheet containing 2.8% of Si and having a thickness of 0.28 mm, having an iron loss value of 1.08 W/kg at $W_{17/50}$ and having a uniform forsterite film on the surface thereof was divided into three pieces A, B and C. Then, the coating liquid II and coating liquid V shown in Table 1 were applied and baked onto the piece A and the pieces B and C respectively to produce grain-oriented silicon steel sheets each having a top coating film. Among them, further in the piece C, linear decreased thickness regions of the forsterite film were formed under an arrangement condition that the width: 0.5 mm, the inclination angle with respect to the rolling direction: 90°, and the interval between adjacent regions in the rolling direction: 3 mm, without forming stretches on the steel sheet matrix surface by a method in which an iron needle with a fine tip was pushed to the steel sheet surface and moved thereon under light pressure to remove the coating film and a part of the forsterite film.

Thereafter, the pieces A, B and C were subjected to the annealing at 700° C. for 1 minute, and it was found that the filmless regions of the coating film adhered onto the surface of the piece C was repaired. The iron loss values of the steel sheets thus obtained were:

A : $W_{17/50}$=1.08 W/kg (Comparative Example)
B : $W_{17/50}$=1.06 W/kg (Comparative Example)
C : $W_{17/50}$=1.01 W/kg (Example)

After these steel sheets were subjected to a stress-relief annealing at 800° C. for 5 hours, the iron loss values thereof were measured. The following results were obtained.

A : $W_{17/50}$=1.08 W/kg (Comparative Example)
B : $W_{17/50}$=1.06 W/kg (Comparative Example)
C : $W_{17/50}$=1.00 W/kg (Example)

EXAMPLE 10

A cold rolled steel sheet of 0.30 mm in thickness was prepared from a hot rolled silicon steel sheet containing 3.2% of Si according to the ordinary method, and subjected to a decarburization primary recrystallization annealing. Then, the resulting steel sheet was divided into two pieces, and one of then as such was coated with an annealing separator consisting mainly of MgO, and then subjected to a final annealing at 1,200° C. for 5 hours to prepare a Comparative Example. The other steel sheet piece was adhered linearly on the surface with $Al_2O_3$ powder as an inhibitor for the reaction of the annealing separator with $SiO_2$contained in the subscales of the steel sheet under a condition that the adhesion amount: 1.5 g/m$^2$, the inclination angle with respect to the rolling direction: 90°, the adhesion width: 2 mm, and the repeating interval in the rolling direction: 4 mm, and the coated with the annealing separator, and subjected to a final annealing.

As a result, in the former case, a uniform grey film was formed, while in the latter case, no forsterite film was formed at the regions to which the $Al_2O_3$ powder was applied. The iron loss values of these steel sheets are as follows:

Comparative Example: $W_{17/50}$=1.06 W/kg
Example: $W_{17/50}$=1.02 W/kg

Each of coating liquids I–VII shown in Table 1 was applied and baked onto each of the above steel sheets to form a top coat insulating film thereon. The iron loss values of thus obtained articles are shown in Table 3. Further, after a stress-relief annealing of the articles was performed at 800° C. for 2 hours, the iron loss values thereof were measured. The obtained results are also shown in Table 3.

It can be seen from Table 3 that the iron loss of the steel sheet having a forsterite film locally having filmless regions was conspicuously improved by the coating film having a thermal expansion coefficient of not higher than $9.8\times10^{-6}$ 1/°C.

TABLE 3

| Kind of coating | Non-forsterite film region | Iron loss value before coating $W_{17/50}$ (W/kg) | Iron loss value after coating $W_{17/50}$ (W/kg) | Iron loss value after stress-relief annealing $W_{17/50}$ (W/kg) | Remarks |
|---|---|---|---|---|---|
| I | No | 1.06 | 1.06 | 1.06 | Comparative example |
| | Present | 1.02 | 1.02 | 1.02 | Example |
| II | No | 1.06 | 1.06 | 1.06 | Comparative example |
| | Present | 1.02 | 1.01 | 1.01 | Example |
| III | No | 1.06 | 1.06 | 1.06 | Comparative example |
| | Present | 1.02 | 1.00 | 0.99 | Example |
| IV | No | 1.06 | 1.06 | 1.05 | Comparative example |
| | Present | 1.02 | 0.98 | 0.98 | Example |
| V | No | 1.06 | 1.04 | 1.04 | Comparative example |
| | Present | 1.02 | 0.97 | 0.96 | Example |
| VI | No | 1.06 | 1.05 | 1.04 | Comparative example |
| | Present | 1.02 | 0.96 | 0.96 | Example |
| VII | No | 1.06 | 1.05 | 1.05 | Comparative example |
| | Present | 1.02 | 0.96 | 0.96 | Example |

EXAMPLE 11

A cold rolled steel sheet of 0.30 mm in thickness was prepared from a hot rolled silicon steel sheet containing 3.2% of Si, and subjected to a decarburization primary recrystallization annealing according to the ordinary method. Then, prior to application of an annealing separator, the surface of the steel sheet was coated with $Fe_2SiO_4$ as an oxidizing agent for Si contained in the steel under a condition that the adhesion amount: 4 g/m$^2$, the inclination angle with respect to the rolling direction: 90°, the width: 2 mm, and the repeating interval in the rolling direction: 10 mm, and further coated with the annealing separator, and subjected to a final annealing at 1,200° C. for 5 hours. For comparison, a grain-oriented silicon steel sheet was prepared as Comparative Example by the ordinary steps in which no oxiding agent-adhering treatment was performed prior to the application of the annealing separator. The iron loss value of the resulting steel sheets are as follows:

Comparative Example: $W_{17/50}$=1.04 W/kg
Example: $W_{17/50}$=0.99 W/kg

After a stress-relief annealing of the steel sheets was performed at 800° C. for 2 hours, iron loss values of the steel sheets were measured. The obtained results were as follows:

Comparative Example: $W_{17/50}$=1.04 W/kg
Example: $W_{17/50}$=0.99 W/kg

EXAMPLE 12

A cold rolled steel sheet of 0.30 mm in thickness was prepared form a hot rolled silicon steel sheet containing 3.2% of Si, and subjected to decarburization primary recrystallization annealing. Then, the surface of the resulting steel sheet was coated with an annealing separator consisting mainly of MgO, and subjected to a final annealing at 1,200° C. for 5 hours to obtain a grain-oriented silicon steel sheet having a uniform grey forsterite film on the surface thereof.

The iron loss value of this steel sheet was 1.06 W/kg at $W_{17/50}$. Then, filmless regions were formed in the forsterite film under an arrangement condition that the width: 0.5 mm, the inclination angle with respect to the rolling direction: 90°, and the interval between adjacent regions in the rolling direction: 6 mm, by a method, in which an iron needle with a fine tip was pushed to the steel sheet surface and moved thereon under a light pressure to draw a line and to remove the forsterite film.

As a result, the iron loss of the above treated steel sheet was 1.02 W/kg at $W_{17/50}$. The iron loss value after a stress-relief annealing at 850° C. for 2 hours, was 1.01 W/kg at $W_{17/50}$.

EXAMPLE 13

A grain-oriented silicon steel sheet containing 2.8% of Si, having a thickness of 0.28 mm, having an iron loss value of 1.08 W/kg at $W_{17/50}$, and having a uniform forsterite film formed on the surface thereof was divided into three pieces A, B and C. Then, the coating liquid II and the coating liquid VI shown in Table 1 were applied and baked onto the piece A and the pieces B and C respectively to produce grain-oriented silicon steel sheets each having a top coating film. Further, in the piece C, linear filmless regions were formed in the forsterite film under an arrangement condition that the width: 0.5 mm, the inclination angle with respect to the rolling direction: 90°, and the interval between adjacent regions in the rollings direction: 5 mm, without forming scratches on the steel sheet matrix surface by a method in which an iron needle with a fine tip was pushed to the steel sheet surface and moved thereon under a light pressure to remove the coating film and forsterite film.

The pieces A, B and C were subjected to an annealing at 800° C. for 10 minutes. In the piece C, the filmless regions of coating film on the surface of the piece C were repaired by such an annealing treatment. The iron loss values of the thus treated steel sheets were:

A : $W_{17/50}$=1.09 W/kg
B : $W_{17/50}$=1.06 W/kg
C : $W_{17/50}$=1.02 W/kg

After a stress-relief annealing was performed for the above treated steel sheets at 800° C. for 5 hours, the iron loss values thereof were measured. The obtained results were as follows:

A : $W_{17/50}$=1.09 W/kg
B : $W_{17/50}$=1.06 W/kg
C : $W_{17/50}$=1.02 W/kg

What is claimed is:

1. A grain-oriented silicon steel sheet having a low iron loss free from deterioration due to stress-relief annealing, said steel sheet containing about 2.0–4.0% by weight of Si, and having no plastically strained regions in a matrix surface layer and having a forsterite film said forsterite film locally having regions, which have a thickness different from that of the remaining regions in the film and have been periodically or regularly formed in the film, and said steel sheet further having a tension-giving type insulating coating film having a linear thermal expansion coefficient of not higher than $9.8\times10^{-6}$ 1/°C. formed on top of the forsterite film.

2. A steel sheet according to claim 1, wherein the regions, which have a thickness different from that of the remaining regions in the forsterite film, are continuous or discontinuous linear grooves or lands.

3. A steel sheet according to claim 2, wherein the continuous or discontinuous linear grooves or lands are inclined at an angle of 60°–90° with respect to the rolling direction of the steel sheet.

4. A steel sheet according to claim 1, wherein the regions, which have a thickness different from that of the remaining regions in the forsterite film, have a thickness different by not less than 0.3 μm from that of the remaining regions in the film.

5. In a method of producing a grain-oriented silicon steel having a low iron loss free from deterioration due to stress-relief annealing, wherein a hot rolled sheet produced from a silicon-containing steel slab, containing about 2.0–4.0% by weight of Si, through a hot rolling is subjected to one cold rolling or two or more cold rollings with an intermediate annealing between them to produce a cold rolled sheet having a final gauge, the cold rolled sheet is subjected to a decarburization primary recrystallization annealing, an annealing separator consisting mainly of MgO is applied to the surface of the decarburized and primarily recrystallized steel sheet, and the thus treated steel sheet is subjected to a final annealing to form a forsterite film on the steel sheet surface, the improvement comprising forming a forsterite film, which has locally filmless regions in the film, by a process, wherein the forsterite film formed during the final annealing is locally removed by the reaction of forsterite with alkali or acid without causing a plastic strain in the interior of the steel sheet.

* * * * *